United States Patent [19]

Quintana

[11] Patent Number: 4,650,497

[45] Date of Patent: Mar. 17, 1987

[54] QUENCH CHAMBER STRUCTURE FOR A DOWN FLOW HIGH PRESSURE GASIFIER

[75] Inventor: Manuel E. Quintana, Yonkers, N.Y.

[73] Assignee: Texaco Development Corp., White Plains, N.Y.

[21] Appl. No.: 731,197

[22] Filed: May 6, 1985

[51] Int. Cl.[4] ..... C10J 3/48

[52] U.S. Cl. ..... 48/69; 48/DIG.2; 55/256

[58] Field of Search ..... 48/69, 77, DIG. 2, DIG. 7, 48/63, 64, 76; 55/256; 261/121 R

[56] References Cited

U.S. PATENT DOCUMENTS

| | | | |
|---|---|---|---|
| 2,818,326 | 12/1957 | Eastman et al. | 261/121 R |
| 4,218,423 | 8/1980 | Robin et al. | 48/69 |
| 4,309,195 | 1/1982 | Rotter | 48/63 |
| 4,314,826 | 2/1982 | Vollhardt | 48/69 |
| 4,377,132 | 3/1983 | Koog et al. | 48/69 |
| 4,456,455 | 6/1984 | Shoebotham | 48/76 |
| 4,494,963 | 1/1985 | Reich | 48/69 |

*Primary Examiner*—Peter Kratz

*Attorney, Agent, or Firm*—Robert A. Kulason; James J. O'Loughlin

[57] ABSTRACT

With a down flow high pressure gasifier, there is a quench chamber that employs a dip tube for confining the effluent from the gasifier. The quench chamber is coaxial with the dip tube. The dip tube extends beneath the surface of a body of quench liquid, and the exit from the quench chamber is above the surface of the quench liquid. That exit is constructed so that the effluent flow out of the quench chamber is symmetrical relative to the axis of the dip tube in order to minimize the liquid carry over with the effluent.

4 Claims, 7 Drawing Figures

QUENCH CHAMBER STRUCTURE FOR A DOWN FLOW HIGH PRESSURE GASIFIER

BACKGROUND OF THE INVENTION

1. Field of the Invention

This invention concerns structure of a quench chamber for solids and/or liquid gasifiers, in general. More specifically it relates to an improvement of quench chamber structure of the type that employs a dip tube with a down flow high pressure gasification generator.

2. Description of the Related Art

The U.S. Pat. No. 4,218,423 to Robin et al, which issued Aug. 19, 1980, illustrates a typical prior arrangement of the quench chamber structure in a gasifier outlet which employs a dip tube and a quench chamber for receiving the effluent from the gasifier. It has been found that with that arrangement the capacity of the system was limited by excessive carryover of liquid from the quench bath through the exit from the quench chamber. Such significant liquid carryover results from the effluent gas flowing through a single exit port. This invention provides for an improvement of the structure of such a combination, so that quench liquid carry over is minimized.

Thus, it is an object of this invention to provide symmetrical outlet structure from a quench chamber. The combination employs a dip tube for carrying effluent from a high pressure gasifier into a quench chamber and through a liquid quench bath.

SUMMARY OF THE INVENTION

Briefly, invention is in the combination with a down flow high pressure gasifier or the like, having a quench chamber for receiving effluent from said gasifier. The said quench chamber comprises a body of quench liquid, a dip tube for confining said effluent to a flow path into said quench liquid beneath the surface thereof, and means for removing gas from said quench chamber above the surface of said body of quench liquid. In that combination there is gas removing means which comprises outlet means having symmetry relative to the axis of said quench chamber.

Again briefly, the invention is in a down flow high pressure gasifier, wherein effluent from said gasifier is confined to a dip tube for causing it to flow through a body of quench liquid to an outlet above the surface of said quench liquid. The said quench liquid container has coaxial symmetry with said dip tube. In that combination, there is means for minimizing carry over of liquid with said gas to said outlet which comprises symmetrical passage means from said container relative to the axis of said dip tube.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

Figure 1:
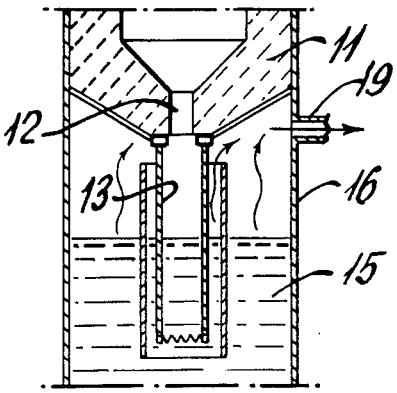
Fig.1. (PRIOR ART)
FIGS. 1 and 2 schematically illustrate prior art structures, in general.
Figure 2:
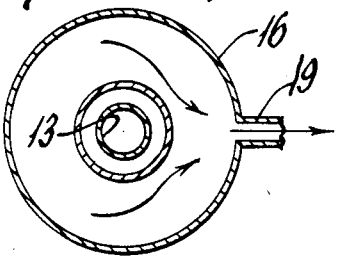
Fig.2. (PRIOR ART)

FIGS. 1 and 2 schematically illustrate the type of structure which has been employed heretofore. It is a combination in which there is a generator or gasifier 11 that is a down flow type. Effluent from the generator goes via a throat 12 through a dip tube 13 into a bath 15 of quench liquid. The quench liquid 15 is contained in a chamber 16 that is coaxial with the dip tube 13. There is an outlet 19 for the effluent after it has been quenched by contact with, and passage through the quench liquid 15. However, it will be noted that this arrangement has an asymmetric relationship of the outlet relative to the axis of the dip tube and quench chamber. Consequently, heretofore there has been excessive carry over of the quench liquid with the effluent as it leaves the quench chamber.

Figure 3:
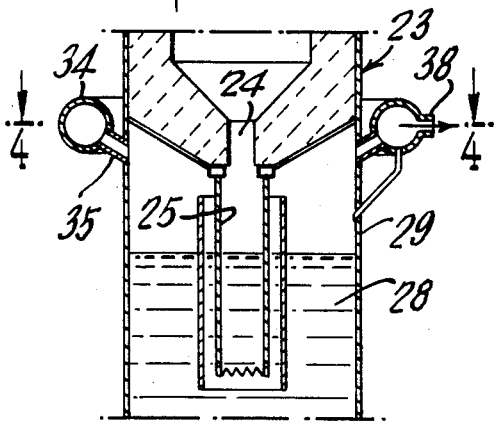
FIG. 3 is a longitudinal cross section schematically showing one modification of the structure according to the invention.
Figure 4:
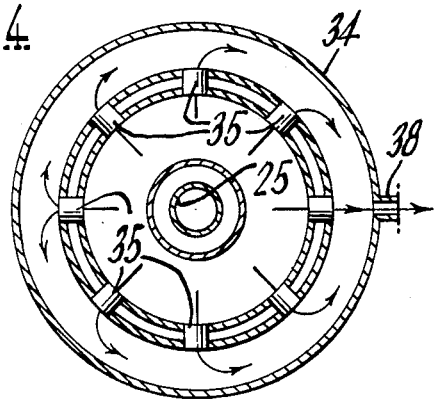
FIG. 4 is a horizontal cross section taken along the lines 4—4 on FIG. 3.

In order to reduce the amount of liquid carry over of the quench liquid from the bath, this invention provides for making a symmetrical outlet to carry the effluent from the chamber above the quench liquid. One modification of the structure for accomplishing a symmetrical outlet is illustrated in FIGS. 3 and 4. There is a gasifier 23 that has a throat 24 through which the effluent from the gasifier exits. It goes into the inside of a dip tube 25. Then, the effluent which is a high temperature gas with entrained slag particles, must pass down through a quench liquid 28 in order to reach the exit. Quench liquid 28 is in a container 29 which is coaxial with the dip tube 25.

The quenched effluent flows symmetrically relative to the axis of the dip tube 25 to a toroidal conduit 34. That flow is via a plurality of radial conduits 35, and it will be noted that there are an even number of these conduits. Also, they are distributed evenly around the circumference of the container 29 so as to make the path of exit flow of effluent symmetrical relative to the axis of the dip tube 25. After the effluent gases have reached the conduit 34 they exit through an outlet 38.

The conduits 35 slope upward from the container 29 so that any liquid may drain back to the bath 28. In addition, there may be provided a small diameter drain pipe 39 from the bottom of the toroidal conduit 34. It is added in order to drain off any carry over of liquids that might reach the interior of the conduit 34. It will be appreciated that by maintaining the symmetrical outlet structure for the effluent, the flow rate of effluent gases is distributed evenly and consequently a reduction in the velocity of flow is obtained whereby the carry over of liquid from the quench liquid bath 28 is substantially reduced.

Figure 5:
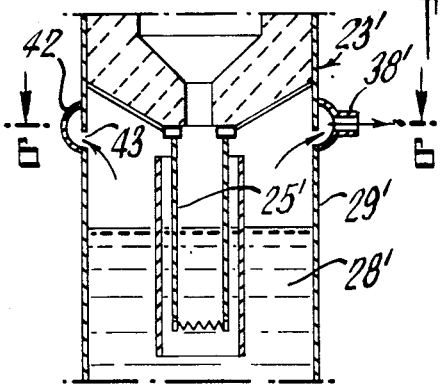
FIG. 5 is a longitudinal cross section schematically showing a different modification according to the invention.
Figure 6:
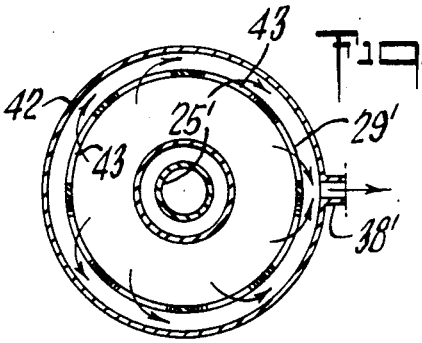
FIG. 6 is a horizontal cross section taken along the lines 6—6 on FIG. 5.

FIGS. 5 and 6 illustrate another embodiment according to this invention. The schematic showings of the basic gasifier and quench chamber, are substantially the same as those illustrated in FIGS. 3 and 4. Therefore, the same reference numerals are applied but with primed numbers. In this modification, the outlet structure for the effluent takes the form of a hollow belt 42. This belt 42 is integrally attached to the outside of the walls of the container 29 in any feasible manner, such as by welding. There are a plurality of symmetrically situated passages through the wall of the container 29' in the form of slots 43. Slots 43 permit the effluent gases to flow into the interior of the belt 42 in a symmetrical manner relative to the axis of the dip tube 25' From the belt 42, the effluent gases flow out through an outlet 38'. It will be noted that the slots 43 are located at the bottom of the hollow belt 42. Consequently, any liquid carry over into the belt may drain back into the chamber inside the container 29' and so rejoin the liquid quench bath 28'. It should be noted that the circumferentially located slots 43 may take any feasible form. Thus, they might even comprise an opening or slot (not shown) extending all the way around the periphery of the container 29'. In any event, the symmetry relative to the axis of the dip tube 25' is maintained, and it is effective to provide even distribution of the effluent flow which substantially reduces the amount of carry over of the liquid from the quench liquid bath 28'.

Figure 7:
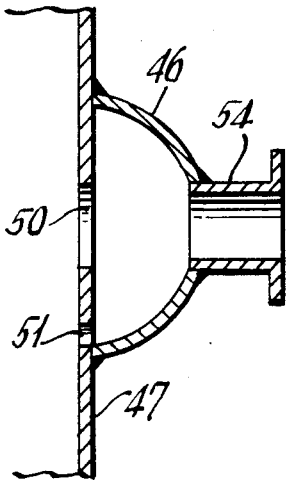
FIG. 7 is an enlarged detail showing yet another modification of a belt type outlet structure similar to that illustrated in FIGS. 5 and 6.

FIG. 7 illustrates a modification of the structure illustrated in FIGS. 5 and 6. This modification takes the form of a hollow belt 46 that is welded onto the outside of a container 47. Container 47 is of course substantially the same type of structure as the containers illustrated in FIGS. 3–6. In the FIG. 7 modification, the passages from the inside of the container 47 take the form of slots or holes 50. These slots 50 are located above the bottom of the belt 46 and are symmetrically located all the way around the circumference of the container 47 in a similar manner as the other modifications. In this modification there is a series of weep holes 51 located at the bottom edge of the belt 46 so that accumulation of any partial carry over of liquid with the effluent may drain back into the inside of container 47. In this case there will be, of course, an outlet 54 to carry the effluent away from the interior of the belt 46.

From the foregoing it will be appreciated that by providing a structure of the outlet path from the quench chamber that is symmetrical relative to the axis of the dip tube, the gases exiting through the quench liquid bath will be evenly distributed. Consequently, it provides an improved chance for the entrained liquid to separate and return to the quench chamber, rather than be carried over with the exit gases from the whole unit. Also, it will be apreciated that the structure of the means for providing such an outlet, might take various forms so long as it is symmetrical relative to the axis of the dip tube in a gasifier according to the type to which this invention applies.

While particular embodiments of the invention have been described above in considerable detail in accordance with the applicable statutes, this is not to be taken as in any way limiting the invention but merely as being descriptive thereof.

I claim:

1. In combination with a downflow, high pressure gasifier reactor comprising a shell which defines a combustion chamber in which a carbonaceous fuel is burned to produce a usable gas and a disposable effluent, means forming a container in said gasifier reactor positioned beneath said combustion chamber and holding a body of liquid to define an intermediate space between the surface of said body of liquid and said combustion chamber, a dip tube having the upper end communicated with the combustion chamber and having the lower end immersed in said body of liquid to conduct a stream of produced gas and effluent into the body of liquid, a plurality of openings formed in said means forming a container, being in communication with said intermediate space, thereby defining an outlet for produced gas having symmetry relative to the vertical axis of said quench chamber, whereby to conduct produced gas and effluent from said intermediate space, a manifold depending from said container exterior wall and mutually communicating the respective plurality of openings with each other, at least one drain opening formed at the lowest point in said manifold, being in communication with the means forming said container to allow water which has accumulated in the manifold to flow therefrom and into said container.

2. In the combination as defined in claim 1, wherein the means forming said plurality of openings comprises;

a plurality of radial conduits aligned with an upward slope from said container to said manifold.

3. In the combination as defined in claim 1, wherein said plurality of openings are equispaced about the walls of said means forming said container.

4. In the combination as defined in claim 1, wherein the means forming said plurality of openings comprises;

a plurality of equispaced slots formed in a wall of said means forming a container.

* * * * *